US007017672B2

(12) United States Patent
Owen, Sr.

(10) Patent No.: US 7,017,672 B2
(45) Date of Patent: Mar. 28, 2006

(54) SELF-SET BRIDGE PLUG

(75) Inventor: Harrold D. Owen, Sr., Fort Worth, TX (US)

(73) Assignee: Go II Oil Tools, Inc., Fort Worth, TX (US)

( * ) Notice: Subject to any disclaimer, the term of this patent is extended or adjusted under 35 U.S.C. 154(b) by 0 days.

(21) Appl. No.: 10/833,462

(22) Filed: Apr. 28, 2004

(65) Prior Publication Data

US 2004/0216868 A1 Nov. 4, 2004

Related U.S. Application Data

(60) Provisional application No. 60/467,742, filed on May 2, 2003.

(51) Int. Cl.
*E21B 23/04* (2006.01)

(52) U.S. Cl. ..... 166/387; 166/63; 166/123

(58) Field of Classification Search ..... 166/387, 166/63, 123, 181
See application file for complete search history.

(56) References Cited

U.S. PATENT DOCUMENTS

| | | | | |
|---|---|---|---|---|
| 2,121,002 | A | 6/1938 | Baker | |
| 2,217,747 | A | 10/1940 | Henderson | |
| 2,618,343 | A | 11/1952 | Conrad | |
| 2,695,064 | A | 11/1954 | Ragan et al. | |
| 2,713,910 | A | 7/1955 | Baker et al. | |
| 2,751,018 | A | 6/1956 | Baker | |
| 2,791,278 | A | 5/1957 | Clark, Jr. | |
| 2,807,325 | A | 9/1957 | Webb | |
| 3,082,824 | A | 3/1963 | Taylor et al. | |
| 3,186,485 | A | 6/1965 | Owen | |
| 3,266,575 | A | 8/1966 | Owen | |
| 3,360,049 | A * | 12/1967 | Kisling, III | 166/123 |
| 4,784,226 | A | 11/1988 | Wyatt | |
| 5,024,270 | A | 6/1991 | Bostick | |
| 5,146,983 | A | 9/1992 | Hromas et al. | |
| 5,203,414 | A | 4/1993 | Hromas et al. | |
| 5,819,846 | A | 10/1998 | Bolt, Jr. | |
| 6,155,350 | A | 12/2000 | Melenyzer | |
| 6,481,496 | B1 * | 11/2002 | Jackson et al. | 166/120 |

* cited by examiner

*Primary Examiner*—William Neuder
(74) *Attorney, Agent, or Firm*—Mark W. Handley; Chauza & Handley, L.L.P.

(57) ABSTRACT

A well tool (12) includes a mandrel (86), a collar (64), a sleeve (76) and a piston body (88). The collar (64) is disposed above and the sleeve (76) is disposed beneath a seal element (70), a conical element (72) and slips (74). A central bore (92) extends into the mandrel (86), and a flow port (96) extends from the central bore (92) to an exterior of the mandrel (86) which is adjacent to the sleeve (76). The piston body (88) extends exteriorly outward of the mandrel (86) and beneath the flow port (96). The sleeve (76) extends exteriorly around and slidably engages the mandrel (86) and the piston body (88). A setting pressure applied to the central bore (92) and passed through the flow port (96) moves the sleeve (76) upwards on the mandrel (86) to press the slips (74), the conical element (72) and the seal element (70) between the sleeve (76) and the collar (64) to set the well tool (12).

14 Claims, 3 Drawing Sheets

SELF-SET BRIDGE PLUG

CROSS-REFERENCE TO RELATED APPLICATIONS

The present invention is a continuation-in-part of U.S. Provisional Patent Application Ser. No. 60/467,742, filed May 2, 2003, entitled "SELF-SET BRIDGE PLUG" and invented by Harold D. Owen, Sr.

TECHNICAL FIELD OF THE INVENTION

The present invention relates in general to downhole well tools, and in particular, to bridge plugs, packers and retainers for setting within wells.

BACKGROUND OF THE INVENTION

Well tools, such as bridge plugs, packers and cement retainers, have been used for setting in earthen wells to seal well casings. Prior art well tools, such as bridge plugs, packers and retainers, typically each include a mandrel which provides a central member and which defines a longitudinal axis of the respective bridge plug, packer or retainer. The mandrel may be a tubular member which provides a fluid flow passage through the mandrel, but in the case of a bridge plug an interior passage through the bridge plug is sealed. In the prior art, an upper and lower sleeve are concentrically mounted around opposite ends the mandrel. In one conventional arrangement, the lower sleeve is fixedly mounted to the lower end of the mandrel and the upper sleeve is slidably moveable over the mandrel for moving toward the lower sleeve to set the respective well tool within a well casing. Disposed around the exterior of the mandrel and between the upper and lower sleeves are conically shaped elements and an elastomeric seal element, with the seal element located between the two conical elements. Slips are slidably disposed on opposite ends of the conical elements. The slips are typically defined by separate segments which are disposed around an outer circumference of a respective one of the conical elements. The slip segments have serrated outer surfaces which define grip teeth, the crests of which will cut into the casing disposed in a well to secure the well tool to the casing. The inner surfaces of the slips respective ones of the slip segments together define frusto-conical shaped inner surfaces which slidably engage mating frusto-conically shaped outer surfaces of the two conical elements, such that when the upper and lower sleeves are pushed toward one another as the well tool is being set, the slips are pushed outward and wedged between the conical elements and the casing. When the well tool is set, the seal element will be squeezed between the ends of the two conical elements to sealingly engage between the outer surface of the mandrel and the casing.

Prior art well tools, such as bridge plugs, packers and retainers, have typically been set by rigidly securing the upper end of the mandrel to a setting tool. The setting tool typically includes a setting sleeve which extends around the mandrel and engages the upper sleeve. As the setting tool is operated, the setting sleeve will push downward against the upper sleeve as the upper end of the mandrel is held in place. Preferably, the lower sleeve is fixedly mounted to the lower end of the mandrel and the upper sleeve is slidably moveable over the mandrel for moving toward the lower sleeve to set the well tool within a well casing. The setting sleeve of the setting tool will operate to stroke downward and push the upper sleeve toward the lower sleeve which is fixed in relation to the mandrel. The upper sleeve will then move downward toward lower sleeve, pushing the slips over the conical elements and pressing the elastomeric seal element between ends of the two conical elements to set the well tool within a well casing. During setting of the well tool, a shear pin will be sheared to release the setting tool from the set well tool so that the setting tool may be retrieved from the well and be redressed for use to set other well tools.

SUMMARY OF THE INVENTION

A novel self-set well tool is disclosed which includes a seal element, a conical element and slips which extend around a central portion of a mandrel. The slips are slidably moveable over the conical element, which urges the slips outward and into a well casing to anchor the well tool to the well casing. A collar defines a stop ring, or a retainer ring, which is disposed above the seal element, the slips and the conical element. A central bore extends into a central portion of the mandrel, and a setting pressure is selectively applied within the central bore to set the well tool. A flow port extends from the central bore, through the central portion of the mandrel to an exterior of the mandrel. A piston body extends exteriorly outward of the central portion of the mandrel, and beneath the flow port. The piston body is preferably provided by a lower portion of the mandrel. A sleeve extends exteriorly around the central portion of the mandrel, beneath the seal element, the slips and the conical element. The sleeve has an upper end which slidably engages the exterior of the central portion of the mandrel and a lower portion which is spaced apart from the central portion of the mandrel and defines a cylinder which slidably engages the piston body to define a chamber. The chamber is preferably annular-shaped and defined to extend between the interior of the sleeve and an exterior portion of the central portion of the mandrel, and has a height which is defined between an upper portion of the sleeve and an upper portion of the piston body. The sleeve is slidably mounted to the mandrel, such that the chamber is disposed adjacent to the flow port for receiving the setting pressure from the central bore and moving upwards on the central portion of the mandrel to press the slips, the conical element and the seal element between the sleeve and the collar to engage the slips on the conical elements to anchor the well tool in the well casing and to squeeze the seal element between the mandrel and the well casing.

DESCRIPTION OF THE DRAWINGS

For a more complete understanding of the present invention and the advantages thereof, reference is now made to the following description taken in conjunction with the accompanying Drawings which show various aspects for a self-set bridge plug device made according to the present invention, as set forth below.

DETAILED DESCRIPTION OF THE INVENTION

Figure 1:
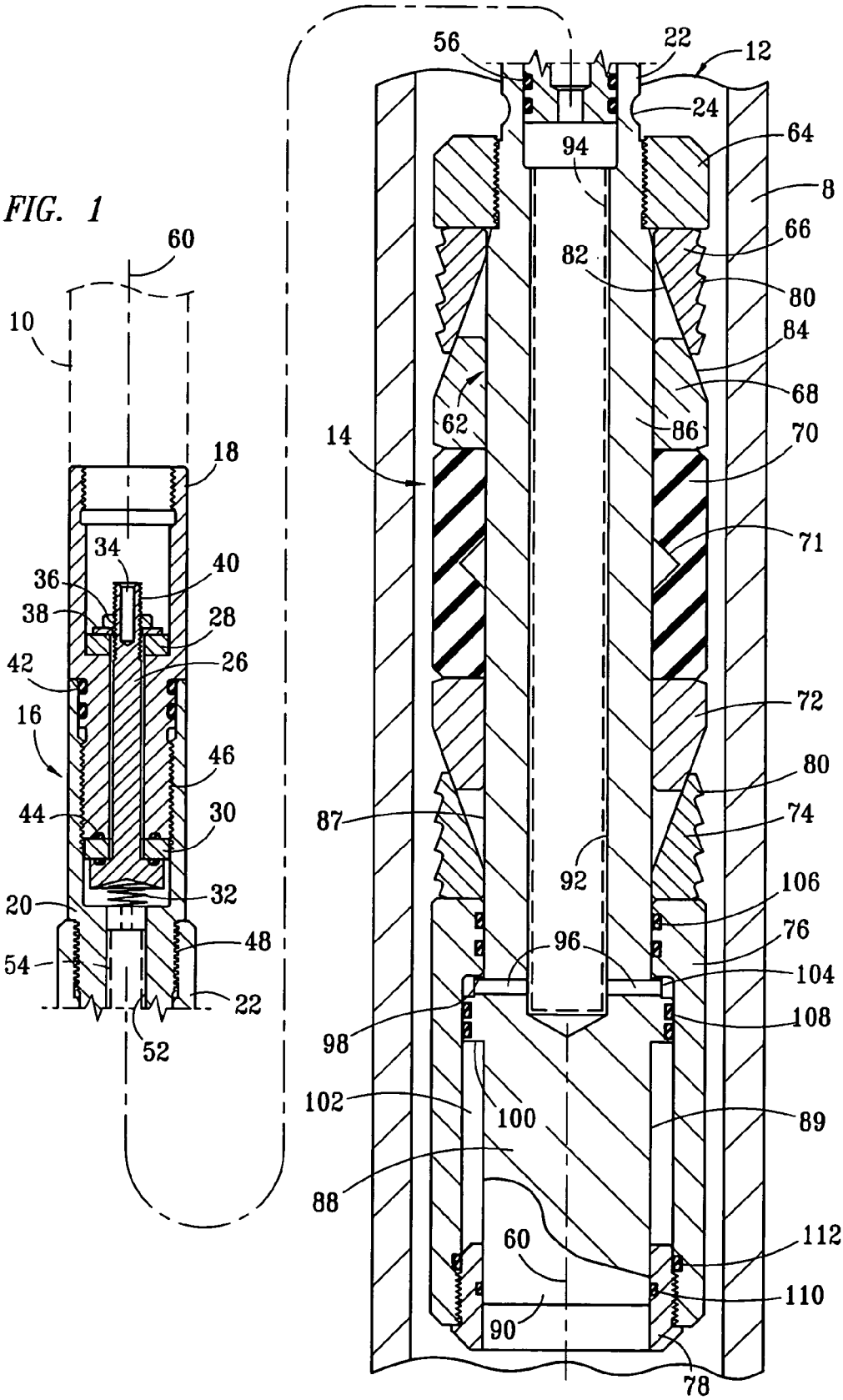
FIG. 1 is a longitudinal section view of self-set bridge plug shown prior to being set.

FIG. 1 is a longitudinal section view of a self-set bridge plug 12 shown prior to being set, disposed on a tool string 10 after being run into a well casing 8. The self-set bridge plug 12 is a well tool having a tool body 14 and a retrievable section 16. The retrievable section 16 includes an adapter sub 18 and a firing head, or ignitor sub, 20 which are threadingly secured together at a threaded connection 46. The adapter sub 18 is secured to the lower end of the tool string 10. The ignitor sub 20 is threadingly secured to the upper end of a weak point section 22 by threaded connection 48. The weak point section 22 has a weak point 24 which is preferably an annular shaped region defined by a groove which circumferentially extends into an exterior periphery of the weak point section 22 to reduce the cross-sectional area of the material from which the weak point section 22 is formed, as compared to the cross-sectional area of adjacent portions of the weak point section. The annular shaped region of reduced cross-sectional area defining the weak point 24 will have a reduced pull strength as compared to the other portions of the weak point 24, and will separate at a predetermined pull strength after the bridge plug 12 is set within the well casing 12.

An insulated contact rod 26 is mounted within the adapter sub 18 of the retrievable section 16, with electrical insulators 28 and 30 preventing electrical contact between the contact rod 26 and the conductive metal housing of the adapter sub 18. A contact spring 32 contacts the lower end of the contact rod 26, and a contact spring socket 34 is formed to extend into the upper end of the contact rod 26 for receiving a spring contact from the lower end of the tool string 10. The lower end of the central spring 32 contacts the upper end of an ignitor 54 (shown in phantom). The lower end of the contact rod 26 is enlarged to define a head having an upwardly facing shoulder for engaging against the insulator 30. The upper end 40 of the contact rod 26 is threaded for receiving a lock nut 36 and washer 38 to secure the contact rod 26 within the adapter sub 18. O-ring seals 42 are provided in two places to seal between the adapter sub 18 and the ignitor sub 20. O-ring seals 44 are provided in two places for sealing between the upward face of the insulator 30 and the lower end face of the adapter sub 18, and between the lower face of the insulator 30 and an upwardly facing shoulder of the head defined by the lower end of the contact rod 26. The ignitor sub 20 has an ignitor chamber 52, within which is disposed the ignitor 54 (shown in phantom). O-ring seals 56 are provided in two places to seal between the outer periphery of the lower end of the ignitor sub 20 and the interior of the weak point section 22.

The self-set bridge plug 12 has a mandrel 62 which preferably extends through a central portion of the bridge plug 12 and defines a central, longitudinal axis 60 of the bridge plug 12. The mandrel 62 is preferably concentrically disposed with the longitudinal axis 60. An upper portion of the mandrel 62 preferably includes the weak point section 22. A collar 64 extends circumferentially around an upper end of the mandrel 62 and defines a stop ring, or retainer ring. The groove defining the weak point 24 is preferably disposed adjacent to the collar 64, preferably located above the top of the collar 64, so that a drill bit will directly engage the collar 64 without having to drill through an upper portion of the mandrel 62 to reach the collar 64 if the bridge plug 12 is later drilled out. Uppers slips 66 have a upwardly facing ends which abut the lower end of the collar 64. An upper conical element 68 is disposed beneath the upper slips 66 and adjacent to the upper end of a seal element 70. The seal element 70 is preferably formed of an elastomer, and has an interiorly disposed undercut groove 71 which extends around an interior circumference of the seal element 70. The groove 71 is preferably V-shaped, having a maximum width of three-quarter inches and a depth of three-eights inches, with a ninety degree included angle. In other embodiments, the seal element 70 be provided without a groove 71, or the groove 71 may be of another shape other than V-shape, such as a one-quarter inch radius to fifty percent of the depth of the seal element 70.

A lower conical element 72 is disposed beneath the seal element 70 and above lower slips 74. A sleeve 76 defines a cylinder which is disposed beneath the lower slips 74, and extends over a piston body 88. A seal ring 78 is threadingly secured to the lower end of the sleeve 76 and slidably engages a lower guide end 90 of the piston body 88. The piston body 88 is preferably defined by a lower end the mandrel 62, being integrally formed with the mandrel 62. That is, the piston body 88 and the mandrel 62 are preferably formed of a singular member. The slips 66 and 74 have serrated outer surfaces 80 which define slip teeth for cutting into the interior wall of the well casing 8 when the bridge plug is set within a well. The upper and lower slips 66 and 74 are preferably separate segments, respective ones of which together define frusto-conical shaped inner surfaces 82 which slidably engage respective ones of frusto-conical shaped outer surfaces 84 of the conical elements 68 and 72 when the plug is set, which urges the slips 66 and 74 to move radially outward from the tool body 14 and engage the slip teeth of the serrated outer surfaces 80 with the interior wall of the well casing 8. The upper slips 66, the upper conical element 68, the seal element 70, the lower conical element 72, the lower slips 74, the sleeve 76 and the seal ring 78 are slidably mounted to a central mandrel body 86 of the mandrel 62 for sliding in a direction parallel to the longitudinal axis 60. In the preferred embodiment, the interior surfaces 82 of the slips 66 and 74 and the exterior surfaces 84 of the conical elements 68 and 72 are smooth, and are held in set positions by locking the outer surfaces 80 of the slips 66 and 72 into the well casing 8. In other embodiments, the interior surfaces 82 of the slips 66 and 74 and the exterior surfaces 84 of the conical elements 68 and 72 may be serrated or have grooves formed therein to provide a rachet means to retain the slips 66 and 74 in set positions relative to respective ones of the conical elements 68 and 72.

The piston body 88 is preferably defined by a lower portion of the mandrel 62. An upper end of said piston body 88 defines an enlarged first part which extends outward of said central portion 86 of said mandrel 62 and engages the sleeve 76. A lower end of the piston body 88 defines the lower guide end 90, over which the sleeve 76 and the seal ring 78 are slidably moveable. The lower guide end 88 preferably has a diameter 89 which is substantially equal in size to the diameter 87 of said central portion 86 of said mandrel 62, such that when said seal ring 78 engages said lower guide end 88, the well pressure acting across said mandrel 62 is equalized. A power charge chamber 92 is defined by a central bore which extends into the central mandrel body 86, preferably as a blind hole which terminates at the piston body 88 in the lower end of the mandrel 62. The power charge chamber 92 is preferably of a size having an interior diameter which is not larger than forty percent (40%) of the exterior diameter of the central body portion 86 of the mandrel 62. If the interior of the power charge chamber 92 or exterior of the central body 86 of the mandrel 62 are not round, then a ratio of effective cross-sectional areas calculated from the cross-sectional areas of the power charge chamber 92 or the central body 86 will preferably be used to determine that the maximum size of the power charge chamber 92 as compared to the exterior of the central body portion 86 of the mandrel 62. A power charge 94 is shown in phantom disposed within the power charge chamber 92. The power charge 94 is preferably of a size which extends substantially the full length of the power charge chamber 92, preferably at least ninety percent of the length of the power charge chamber 92, and which has an exterior diameter which is no smaller then seventy-five percent (75%) of the interior diameter of the power charge chamber 92. If the power charge chamber 92 or the power charge 94 are of a shape other than cylindrical, then the effective diameter of the power charge 94 should be compared to the effective diameter of the power charge chamber 92, with the effective diameters determined by calculation from the cross-sectional areas of the power charge chamber 92 and the power charge 94. Preferably, the power charge is a slower burning type power charge, in which combustion takes thirty to fifty seconds, as opposed to no longer than fifteen seconds for conventional power charges.

Flow ports 96, preferably two, extend radially outward from a lower portion of the power charge chamber, with the ports 96 preferably having axes which are angularly disposed one hundred and eighty degrees apart around and at right angles the longitudinal axis 60. A downwardly facing, annular-shaped shoulder 98 is disposed in the interior of the sleeve 76 and a downwardly facing, annular-shaped shoulder 100 is disposed on the exterior of the piston body 88. A lower, annular-shaped chamber 102 is defined to extend between the interior of the sleeve 76 and the exterior of the piston body 88. The upper end of the piston body 88 is enlarged to engage the interior wall of the sleeve 76, and defines an upper end of the annular-shaped chamber 102. The lower end of the annular-shaped chamber 102 is preferably defined by the upper end of the seal ring 78. An upper, annular-shaped chamber 104 is disposed above the lower annular-shaped chamber 102, and is preferably defined to extend between the exterior of the central mandrel body 86 and the interior wall of the sleeve 76 which extends beneath the shoulder 98. The upper end of the annular-shaped chamber 104 is preferably defined by the shoulder 98. The lower end of the annular-shaped chamber 104 is preferably defined by the enlarged upper end of the piston body 88. The flow ports 96 connect between the power charge chamber 92 and the annular-shaped chamber 104, providing fluid communication between the power charge chamber 92 and the annular-shaped chamber 104. The outer diameter 87 of the central portion 86 of the mandrel 62 is preferably the same size as the outer diameter 89 of the piston body 88, providing equal cross-sectional areas as determined across the respective diameters 87 and 89. Providing substantially equal cross-sectional areas, as determined across the diameters 87 and 89, equalizes the well pressure applied to the mandrel 62 at the seal element 71, the upper end of the sleeve 76 and the seal ring 78, such that the well pressures acting on the well tool are balanced so that pressure from the power charge 94 will not be required to overcome downhole well pressures to move the sleeve 76 upwards when the well tool 12 is set. Preferably, the cross-sectional area of the annular-shaped chamber 102 is substantially equal to the cross-sectional area of the annular-shaped chamber 104.

O-ring seals 106, preferably two, seal between the exterior of the central mandrel body 86 and the portion of the interior bore of the sleeve 76 which is disposed above the shoulder 98. O-ring seals 108 seal between the enlarged upper end of the piston body 88 and the portion of the interior bore of the sleeve 76 which is disposed beneath the shoulder 98. O-ring seal 110 seals between the interior of the seal ring 78 and the exterior of the piston body 88, slidably and sealing engaging the lower guide end 90 of the piston body 88. O-ring seal 112 seals between the exterior of the seal ring 78 and the interior of the lower end of the sleeve 76.

Figure 2:
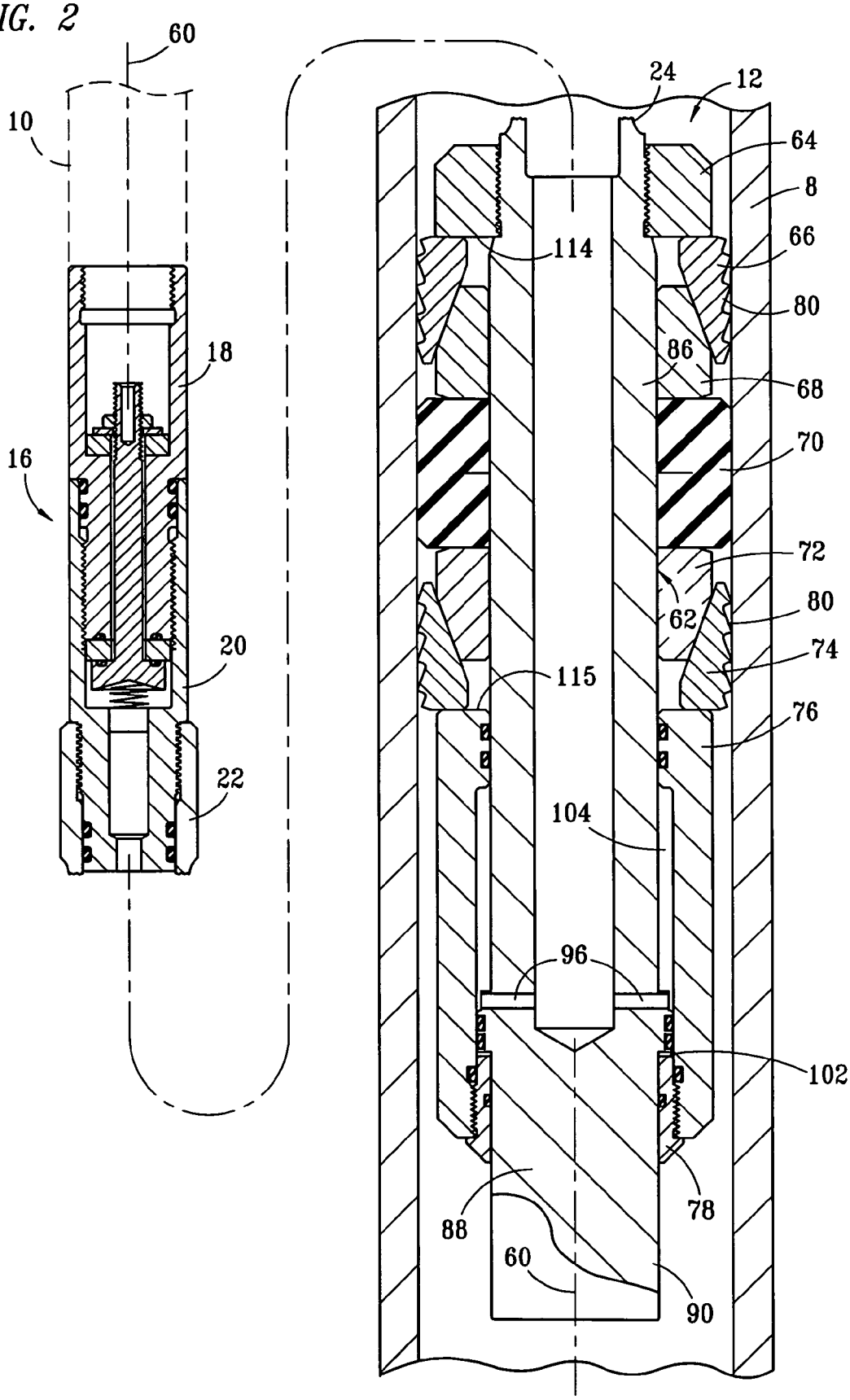
FIG. 2 is a longitudinal section view of the self-set bridge plug after being set within a well casing.

FIG. 2 is a longitudinal section view of the self-set bride plug 12 after being set within the well casing 8. Pressure from burning of the power charge 94 passed through the flow ports 96 and into the annular-shaped chamber 104, pushing the sleeve 76 upwards on the central portion 86 of the mandrel 62 and the piston body 88, opening the annular space 104 and closing the annular space 102. Upward movement of the sleeve 76 presses the slips 66 and 74, the conical element 68 and 72, and the seal element 70 between the downward facing end of the collar 64, which defines a shoulder 114, and the upward facing end of the sleeve 76, which defines a shoulder 115. The slips 66 and 74 are wedged between the well casing 8 and respective ones of the conical elements 68 and 72, which anchors the bridge plug 12 within the well casing 8. The seal element 70 is compressed between the well casing 8 and the mandrel 62 with a compressive pressure which seals between the well casing 8 and the mandrel 62. After the bridge plug 12 is set, the pressure continues to increase until the annular-shaped weak point 24 of the weak point section 22 is sheared. The adapter sub 18, the ignitor sub 20 and an upper portion of the weak point section 22 of the mandrel are retrieved from the well with the tool string 10.

Figure 3:
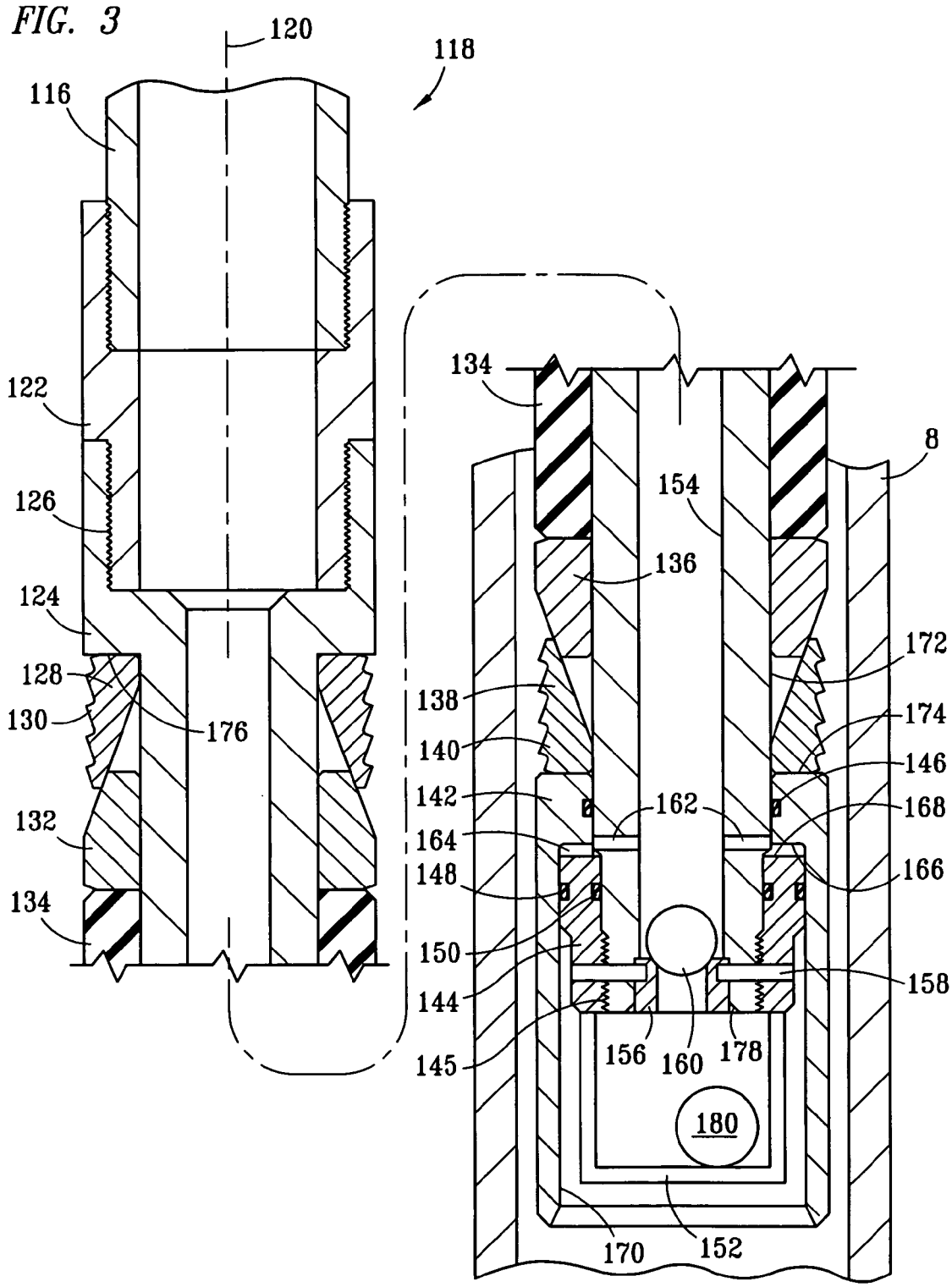
FIG. 3 is a longitudinal section view of a tubing-set cement retainer.

FIG. 3 is a longitudinal section view of a well tool 118, shown as a tubing-set cement retainer. The well tool 118 is shown prior to being set, disposed on a tool string 116 after being run into the well casing 8. The cement retainer 118 has a longitudinal axis 120. The retainer 118 has an adapter 122 which secures the retainer 118 to the tool string 116. The cement retainer 118 has a mandrel 124, which preferably extends through a central portion of the cement retainer 118, concentric with a longitudinal axis 120 of the cement retainer 118. The adapter 122 is secured to the upper end of the mandrel 124 by a threaded connection 126, which may be rotated to release the threaded connection 126 after the retainer 118 is set and retrieved from within the well casing 8 with the tool string 116. An upper portion of the mandrel 124 defines a retainer ring, which provides a downward facing shoulder 176. Upper slips 128 have a upwardly facing ends which abut the lower end of the downward facing shoulder 176 of the mandrel 124. An upper conical element 132 is disposed beneath the upper slips 128 and adjacent to the upper end of a seal element 134. The seal element 134 is preferably formed of an elastomer. A lower conical element 136 is disposed beneath the seal element 134 and above lower slips 138. A sleeve 142 defines a cylinder which is disposed beneath the lower slips 138, and slidably mounted to the mandrel 124 to extend over a piston 144. The slips 128 and 138 have serrated outer surfaces 130 and 140 which define slip teeth for cutting into the interior wall of the well casing 8 when the retainer 118 is set within the well casing 8. The upper and lower slips 128 and 130 are defined by segments, respective ones of which together define frusto-conical shaped inner surfaces which slidably engage frusto-conical shaped outer surfaces of respective ones of the conical elements 132 and 136 when the bridge plug is set, which urges the slips 128 and 130 to move radially outward from the mandrel 124 and engage the slip teeth of the serrated outer surfaces 130 and 140 in the interior wall of the well casing 8. The upper slips 128, the upper conical element 132, the seal element 134, the lower conical element 136, the lower slips 138 and the sleeve 142 are slidably mounted to the mandrel 124 for sliding in a direction parallel to the longitudinal axis 120.

An annular-shaped piston 144 is defined by a sleeve 142 mounted to a lower portion of the mandrel 124. The piston 144 is rigidly mounted to a lower end of the mandrel 124, and the sleeve 142 is slidably moveable over the piston 144. The piston 144 may be integrally formed as part of the mandrel 124 in other embodiments. Preferably, the piston 144 is threadingly secured to the lower end of the mandrel 124 with a threaded connection 145. An O-ring seal 146 seals between an interior of the sleeve 142 and an exterior surface 172 of the mandrel 124. An O-ring seal 148 seals between the sleeve 142 and the piston 144. An O-ring seal 150 seals between an interior of the piston 144 and an exterior of a lower end of the mandrel 124. A ball seat 156 is disposed interiorly within the mandrel 124, and is held in place adjacent to the bore 154 by shear pins 158. A ball 160 is dropped from the surface to seal the ball seat 156 when the retainer 118 is being set. Flow ports 162, preferably two, extend radially outward from a lower portion of the bore 154 of the mandrel 124, with the ports 162 preferably having axes which are angularly disposed one hundred and eighty degrees apart around and at right angles the longitudinal axis 120. A downwardly facing, annular-shaped shoulder 166 disposed in the interior of the sleeve 142 and an upwardly facing, annular-shaped shoulder 168 disposed on the upper end of the piston 144 together define upper and lower ends of an annular-shaped chamber 164 which extends between the interior 170 of the sleeve 142 and an exterior surface 172 of the mandrel 124. A ball seat 178 is preferably provided in the lowermost end of the mandrel 124 for sealing with a second ball 180, which is carried downhole with the tool 118 in the cage 152.

In operation, the cement retainer 118 is run into a well, and the ball 160 is dropped through the tool string 116, through the bore 154 and into the ball seat 156. Pressure is then applied from the surface through the tool string 116 and into the bore 154 of the mandrel 124. Fluid will then flow from within the bore 154, through the flow ports 162 and into the annular chamber 164 to push the sleeve 142 upwards as the mandrel holds the piston 144 in place. Continued pressure moves the upward shoulder 174 of the sleeve 142 toward the downward facing shoulder 176 of the mandrel 124, squeezing the slips 128 and 138 against respective ones of the conical elements 132 and 136, and squeezing the seal element 134 between the outer surface of the mandrel 124 and the interior surface of the well casing 8 to set the cement retainer 118. After the retainer 118 is set within the well casing 8, further pressure may be applied to shear the pins 158 to release the ball seat 158 and the ball 160 from within the bore 154 of the mandrel 124, and the ball seat 158 and the ball 160 will drop into the cage 152. The ball seat 158 and the ball 160 are preferably contained within the cage 152. After the retainer 118 is set, cement may be passed through the tool string 116 and through the retainer 118, and then pressure is released and a second ball 180 will flow up from within the cage 152 into the ball seat 178 to seal the bore 154 in the mandrel 124. After the retainer 118 is set, the tool string 116 is preferably later retrieved with the adapter 122 by rotating the tool string 116 and the adapter 122 to the right relative to the upper end of the mandrel 124, and releasing the threaded connection 126 which is preferably provided by left-hand threads.

The present invention provides advantages over the prior art. A well tool made according to the present invention is self-setting, without requiring a separate setting tool to set the bridge plug using a power charge. The well tool has a power charge chamber which extends within the mandrel of the well tool, interiorly within the packing element, slips and conical elements are disposed. The weak point section is disposed above the power charge chamber. An adapter and firing head are used in setting the well tool using the power charge, and the adapter and firing head may be reused to later set other bridge plugs. The pressure is equalized across the well tool, by having an exterior of the piston body being of the same diameter as a central portion of the mandrel. A bridge plug made according to the present invention is preferably set first, and then a weak point is sheared to release the bridge plug from the tool string. The engagement surfaces between the slips and the conical elements are preferably smooth, rather than including surfaces to provide a ratchet means, reducing the costs for manufacturing the well tool. With the weak point shearing immediately above the collar, the well tool may be drilled out easier and quicker since there is not a long body portion extending above the collar. In some circumstances, an overshot type fishing tool may be secured to the collar to release the well tool from a set position by rotating collar to release the threaded connection between the collar and the mandrel. The power charge chamber has an inside diameter which is no larger than forty percent of the size of the exterior of the central portion of the mandrel within which it extends to prevent bursting of the power charge chamber when the well tool is being set. The well tool of the present invention may also be adapted for running on a tubing string and setting with pressure applied through the tubing string. The various parts of the well tool are preferably made of drillable material, such as cast iron. The slidable sleeve providing the cylinder is beneath the packing element such that is may be pushed to the bottom of a well without being drilled.

Although the preferred embodiment has been described in detail, it should be understood that various changes, substitutions and alterations can be made therein without departing from the spirit and scope of the invention as defined by the appended claims.

What is claimed is:

1. In a well tool for use to seal a well casing, said well tool having a mandrel, a collar, a seal element, slips, a conical element and a sleeve, with said collar and said sleeve mounted to said mandrel, and said seal element, said slips and said conical element mounted to said mandrel between said collar and said sleeve, wherein a distance between said collar and said sleeve is reduced to compress said seal element, said slips and said conical element, urging said slips to engage said conical element and anchor said well tool in the well casing, and squeezing said seal element between said mandrel and said well casing to seal therebetween, the improvement comprising:

a central bore extending into a central portion of said mandrel, said central bore defining a flow path in which a pressure is selectively applied, said central bore having an effective diameter which is not substantially larger than forty percent (40%) of an effective exterior diameter of said central portion of said mandrel;

a flow port extending from said central bore to an exterior of said central portion of said mandrel;

a piston body extending beneath said flow port, said piston body having a first part which extends outward of said exterior of said central portion of said mandrel, and a second part which extends from said first portion on an opposite side of said central portion, wherein said second part of said piston body and said central portion of said mandrel have substantially equal cross-sectional areas;

said sleeve defining a cylinder which extends around said central portion of said mandrel, said sleeve having an upper end which slidably engages said exterior of said central portion of said mandrel and a lower portion which is spaced apart from said central portion of said mandrel and slidably engages said first part of said piston body to define a first chamber disposed between said central portion of said mandrel and said sleeve, and extending between said first part of said piston body and said upper end of said sleeve;

a seal ring disposed on said sleeve and slidably engaging said second part of said piston body to define a second chamber disposed between said piston body and sleeve, extending between said seal ring and said first part of said piston body;

wherein said first chamber is disposed adjacent to said flow port for receiving said pressure from said central bore, such that said sleeve moves on said central portion of said mandrel and said piston body toward said collar to set said well tool when said pressure is applied within said central bore; and wherein said central bore extending in said central portion of said mandrel defines a power charge chamber within which is disposed a power charge which is ignited to combust and generate a gas pressure which passes through said flow port to urge said sleeve to move upwards over said central portion of said mandrel; and wherein an effective power charge diameter is not substantially smaller than seventy-five percent of said effective diameter of said central bore defining said power charge chamber.

2. The well tool according to claim 1, wherein an upper portion of said mandrel which is disposed adjacent to said collar is annular shaped and of reduced cross-sectional area as compared to adjacent portions of said mandrel to define a weak point which separates an upper adapter mounted to a tool string to which said mandrel is secured for running into said well casing.

3. The well tool according to claim 1, wherein said seal element has an undercut groove formed into an interior circumference thereof.

4. The well tool according to claim 1, wherein said piston body is disposed in fixed relation to said mandrel, being integrally formed of a lower portion of said mandrel.

5. The well tool according to claim 1, wherein said first and second chambers are annular-shaped and extend continuously around said central portion of said mandrel and said piston, respectively.

6. In a well tool for use to seal a well casing, said well tool having a mandrel, a collar, a seal element, slips, a conical element and a sleeve, with said collar and said sleeve mounted to said mandrel, and said seal element, said slips and said conical element mounted to said mandrel between said collar and said sleeve, wherein a distance between said collar and said sleeve is reduced to compress said seal element, said slips and said conical clement, urging said slips to engage said conical element and anchor said well tool in the well casing, and squeezing said seal element between said mandrel and said well casing to seal there-between, the improvement comprising:

a central bore extending into a central portion of said mandrel, said central bore defining a flow path in which a pressure is selectively applied, said central bore having an effective diameter which is not substantially larger than forty percent (40%) of an effective exterior diameter of said central portion of said mandrel;

a flow port extending from said central bore to an exterior of said central portion of said mandrel;

a piston body extending beneath said flow port, said piston body having a first part which extends outward of said exterior of said central portion of said mandrel, and a second part which extends from said first portion on an opposite side of said central portion, wherein said second pan of said piston body and said central portion of said mandrel have substantially equal cross-sectional areas;

said sleeve defining a cylinder which extends around said central portion of said mandrel, said sleeve having an upper end which slidably engages said exterior of said central portion of said mandrel and a lower portion which is spaced apart from said central portion of said mandrel and slidably engages said first part of said piston body to define a first chamber disposed between said central portion of said mandrel and said sleeve, and extending between said first part of said piston body and said upper end of said sleeve;

a seal ring disposed on said sleeve and slidably engaging said second part of said piston body to define a second chamber disposed between said piston body and sleeve, extending between said seal ring and said first part of said piston body;

wherein said first chamber is disposed adjacent to said flow port for receiving said pressure from said central bore, such that said sleeve moves on said central portion of said mandrel and said piston body toward said collar to set said well tool when said pressure is applied within said central bore; and wherein said power charge burns for at least 30 seconds when ignited.

7. A well tool for use to seal a well easing, said well tool comprising;

a mandrel having a central portion;

a collar disposed to extend around an exterior of said mandrel;

a seal element extending around said central portion of said mandrel;

a conical element disposed to extend around said central portion of said mandrel;

slips extending adjacent to said conical element and slidably moveable over said conical element;

a sleeve disposed to extend around said mandrel, spaced apart from said collar with said seal element, said slips and said conical element disposed between said sleeve and said collar, wherein said sleeve is slidably moveable on said mandrel to reduce a distance between said collar and said sleeve to compress said seal element, said slips and said conical element there-between;

a central bore extending into a central portion of said mandrel, said central bore defining a flow path in which a pressure is selectively applied;

a flow port extending from said central bore to an exterior of said central portion of said mandrel;

a piston body extending beneath said flow port, said piston body having a first part which extends outward of said exterior of said central portion of said mandrel, and a second part which extends from said first portion on an opposite side of said central portion, wherein said second part of said piston body and said ventral portion of said mandrel have substantially equal cross-sectional areas;

said sleeve defining a cylinder which extends around said central portion of said mandrel, said sleeve having an upper end which slidably engages said exterior of said central portion of said mandrel and a lower portion which is spaced apart from said central portion of said mandrel and slidably engages said first part of said piston body to define a first chamber which is annular-shaped and which continuously extends between said central portion of said mandrel and said sleeve, and extending between said first part of said piston body and said upper end of said sleeve;

a seal ring disposed on said sleeve and slidably engaging said second part of said piston body to define a second chamber which is annular-shaped and which continuously extends between said piston body and sleeve, extending between said seal ring and said first part of said piston body;

wherein said first chamber is disposed adjacent to said flow port for receiving said pressure from said central bore, such that said sleeve moves on said central portion of said mandrel and said piston body toward said collar to set said well tool when said pressure is applied within said central bore;

wherein an upper portion of said mandrel which is disposed adjacent to said cellar is annular shaped and of reduced cross-sectional area as compared to adjacent portions of said mandrel to define a weak point which separates an upper adapter mounted to a tool string to which said mandrel is secured for running into said well casing;

wherein said central bore extending in said central portion of said mandrel defines a power charge chamber within which is disposed a power charge which is ignited to combust and generate a gas pressure which passes through said flow port to urge said sleeve to move upwards over said central portion of said mandrel; and wherein an effective power charge diameter is not substantially smaller than seventy-five percent of said effective diameter of said central bore defining said power charge chamber.

8. The well tool according to claim 7, wherein said seal element has an undercut groove formed into an interior circumference thereof.

9. The well tool according to claim 7, wherein said piston body is disposed in fixed relation to said mandrel, being integrally formed of a lower portion of said mandrel.

10. The well tool according to claim 7, wherein said power charge burns for at least 30 seconds when ignited.

11. A well tool for use to seal a well casing, said well tool comprising:

a mandrel having a central portion;

a collar disposed to extend around an exterior of said mandrel;

a seal element extending around said central portion of said mandrel;

a conical element disposed to extend around said central portion of said mandrel;

slips extending adjacent to said conical element and slidably moveable over said conical element;

a sleeve disposed to extend around said mandrel, spaced apart from said collar with said seal element, said slips and said conical element disposed between said sleeve and said collar, wherein said sleeve is slidably moveable on said mandrel to reduce a distance between said collar and said sleeve to compress said seal element, said slips and said conical element there-between;

a central bore extending into a central portion of said mandrel, said central bore defining a flow path in which a pressure is selectively applied;

a flow port extending from said central bore to an exterior of said central portion of said mandrel;

a piston body extending beneath said flow port, said piston body having a first part which extends outward of said exterior of said central portion of said mandrel, and a second part which extends from said first portion on an opposite side of said central portion, wherein said second part of said piston body and said central portion of said mandrel have substantially equal cross-sectional areas;

said sleeve defining a cylinder which extends around said central portion of said mandrel, said sleeve having an upper end which slidably engages said exterior of said central portion of said mandrel and a lower portion which is spaced apart from said central portion of said mandrel and slidably engages said first part of said piston body to define a first chamber which is annular-shaped and which continuously extends between said central portion of said mandrel and said sleeve, and extending between said first part of said piston body and said upper end of said sleeve;

a seal ring disposed on said sleeve and slidably engaging said second part of said piston body to define a second chamber which is annular-shaped and which continuously extends between said piston body and sleeve, extending between said seal ring and said first part of said piston body;

wherein said first chamber is disposed adjacent to said flow port for receiving said pressure from said central bore, such that said sleeve moves on said central portion of said mandrel and said piston body toward said collar to set said well tool when said pressure is applied within said central bore;

wherein an upper portion of said mandrel which is disposed adjacent to said collar is annular shaped and of reduced cross-sectional area as compared to adjacent portions of said mandrel to define a weak point which separates an upper adapter mounted to a tool string to which said mandrel is secured for running into said well casing;

wherein said central bore extending in said central portion of said mandrel defines a power charge chamber within which is disposed a power charge which is ignited to combust and generate a gas pressure which passes through said flow port to urge said sleeve to move upwards over said central portion of said mandrel; and wherein said power charge burns for at least 30 seconds when ignited.

12. A well tool for use to seal a well casing, said well tool comprising:

a mandrel having a central portion;

a collar disposed to extend around an exterior of said mandrel;

a seal element extending around said central portion of said mandrel;

a conical element disposed to extend around said central portion of said mandrel;

slips extending adjacent to said conical element and slidably moveable over said conical element;

a sleeve disposed to extend around said mandrel, spaced apart from said collar with said seal element, said slips and said conical element disposed between said sleeve and said collar, wherein said sleeve is slidably moveable on said mandrel to reduce a distance between said collar and said sleeve to compress said seal element, said slips and said conical element there-between;

a power charge chamber extending into a central portion of said mandrel, said power charge chamber defining a flow path in which a pressure is selectively applied, and having an effective diameter which is not substantially larger than forty percent (40%) of an effective exterior diameter of said central portion of said mandrel, wherein a power charge is disposed within said power charge chamber and ignited to combust and generate a gas pressure;

a flow port extending from said central bore to an exterior of said central portion of said mandrel for passing said gas pressure from said power charge chamber to said exterior of said central portion of said mandrel;

an upper portion of said mandrel which is disposed adjacent to said collar having an annular shaped of reduced cross-sectional area as compared to adjacent portions of said mandrel to define a weak point which separates an upper adapter mounted to a tool string to which said mandrel is secured for running into said well casing;

a piston body integrally formed as part of said mandrel and extending beneath said flow port, said piston body having a first part which extends outward of said exterior of said central portion of said mandrel, and a second part which extends from said first portion on an opposite side of said central portion, wherein said second part of said piston body and said central portion of said mandrel have substantially equal cross-sectional areas;

said sleeve defining a cylinder which extends around said central portion of said mandrel, said sleeve having an upper end which slidably engages said exterior of said central portion of said mandrel and a lower portion which is spaced apart from said central portion of said mandrel and slidably engages said first part of said piston body to define a first chamber which is annular-shaped and which continuously extends between said central portion of said mandrel and said sleeve, and extending between said first part of said piston body and said upper end of said sleeve;

a seal ring disposed on said sleeve and slidably engaging said second part of said piston body to define a second chamber which is annular-shaped and which continuously extends between said piston body and sleeve, extending between said seal ring and said first part of said piston body;

wherein said first chamber is disposed adjacent to said flow port for receiving said pressure from said central bore, such that said sleeve moves on said central portion of said mandrel and said piston body toward said collar to set said well tool when said pressure is applied within said central bore; and wherein an effective power charge diameter is not substantially smaller than seventy-five percent of said effective diameter of said central bore defining said power charge chamber.

13. The well tool according to claim 12, wherein said power charge burns for at least 30 seconds when ignited.

14. The well tool according to claim 13, wherein said seal element has an undercut groove formed into an interior circumference thereof.

* * * * *